US008282249B2

(12) United States Patent
Liang et al.

(10) Patent No.: US 8,282,249 B2
(45) Date of Patent: Oct. 9, 2012

(54) LUMINAIRE

(75) Inventors: Chih-Lung Liang, Taipei (TW); Jui-Lin Tsai, Taipei (TW)

(73) Assignees: Siltek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 0 days.

(21) Appl. No.: 13/086,703

(22) Filed: Apr. 14, 2011

(65) Prior Publication Data

US 2012/0044692 A1 Feb. 23, 2012

Related U.S. Application Data

(60) Provisional application No. 61/375,350, filed on Aug. 20, 2010.

(30) Foreign Application Priority Data

Oct. 28, 2010 (CN) ..... 2010 1 0526494

(51) Int. Cl.
*F21V 33/00* (2006.01)

(52) U.S. Cl. ..... 362/311.02; 362/555; 362/249.02; 362/253

(58) Field of Classification Search ..... 362/311.02, 362/555, 249.02, 800, 254
See application file for complete search history.

(56) References Cited

U.S. PATENT DOCUMENTS

| | | | | |
|---|---|---|---|---|
| 7,229,196 | B2 * | 6/2007 | Hulse | 362/341 |
| 7,628,513 | B2 * | 12/2009 | Chiu | 362/311.02 |
| 7,922,355 | B1 * | 4/2011 | Morejon et al. | 362/247 |
| 2008/0137360 | A1 * | 6/2008 | Van Jijswick et al. | 362/555 |
| 2010/0148650 | A1 * | 6/2010 | Wu et al. | 313/1 |

* cited by examiner

*Primary Examiner* — Laura Tso
(74) *Attorney, Agent, or Firm* — Rosenberg, Klein & Lee

(57) ABSTRACT

A luminaire comprises a lamp holder, a lamp cover, a light-emitting module, and a light guide element. The lamp cover is assembled to the lamp holder to define an accommodating space therebetween. The lamp holder has a platform part protruding into the accommodating space. The light-emitting module is mounted to the platform part, and includes a circuit board and at least one LED disposed on the circuit board. The light guide element is mounted to the platform part, and covers the light-emitting module. The light guide element has an outer diameter longer than that of the platform part. The light guide element is shaped to allow light emitted from the LED to be transmitted out of the lamp cover through the light guide element in a lateral direction, and thus the view angle of the luminaire is increased.

18 Claims, 6 Drawing Sheets

LUMINAIRE

CROSS-REFERENCE TO RELATED APPLICATION

This application claims priority of U.S. provisional application No. 61/375,350, filed on Aug. 20, 2010, and Chinese Application No. 201010526494.9, filed on Oct. 28, 2010.

BACKGROUND OF THE INVENTION

1. Field of the Invention

This invention relates to a luminaire, and more particularly to a luminaire capable of increasing the view angle.

2. Description of the Related Art

Since LEDs (light emitting diodes) have the advantages of power saving, long usage life, and meeting the requirement for environmental protection, they are used widely for illumination.

In the field of bulbs, however, the most popular are still incandescent bulbs since the view angle of a conventional LED lamp is about only 120°, which is much smaller than that of the incandescent bulbs.

Hence, it is desirable to increase the view angle of an LED bulb.

SUMMARY OF THE INVENTION

The object of this invention is to provide a luminaire with an increased view angle.

Accordingly, a luminaire of this invention includes a lamp holder, a lamp cover, a light-emitting module, and a light guide element. The lamp cover is assembled to the lamp holder to define an accommodating space therebetween. The lamp holder has a platform part protruding into the accommodating space. The light-emitting module is mounted to the platform part, and includes a circuit board and at least one LED disposed on the circuit board. The light guide element is mounted to the platform part, and covers the light-emitting module. The light guide element has an outer diameter longer than that of the platform part.

The luminaire of this invention has an effect in that, since the light-emitting module is disposed on the platform part, and since the light guide element is shaped to allow light beams emitted from the LED to be transmitted out of the luminaire through the light guide element and the lamp cover in a lateral direction, the view angle of the luminaire is increased.

BRIEF DESCRIPTION OF THE DRAWINGS

These and other features and advantages of this invention will become apparent in the following detailed description of five preferred embodiments of this invention, with reference to the accompanying drawings, in which.

DETAILED DESCRIPTION OF THE PREFERRED EMBODIMENTS

Figure 1:
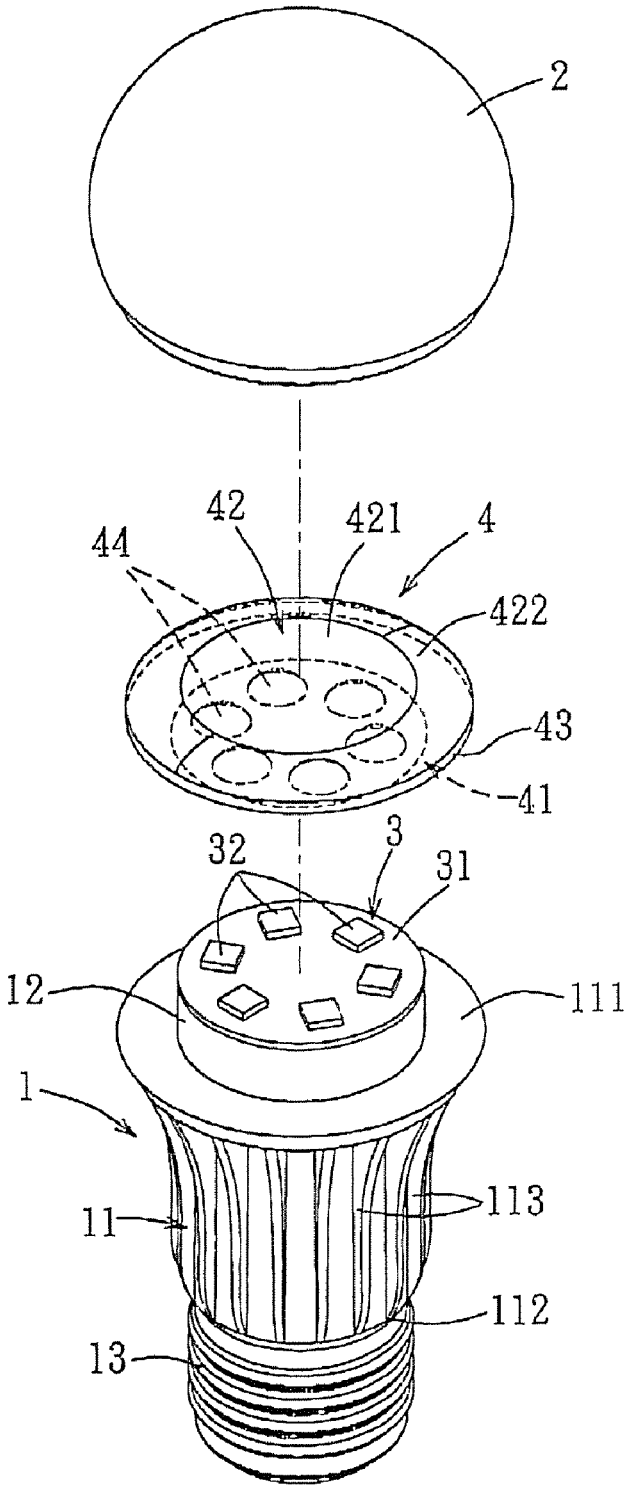
FIG. 1 is a partly exploded perspective view of the first preferred embodiment of a luminaire according to this invention.

Before the present invention is described in greater detail in connection with the preferred embodiments, it should be noted that similar elements and structures are designated by like reference numerals throughout the entire disclosure.

Figure 2:
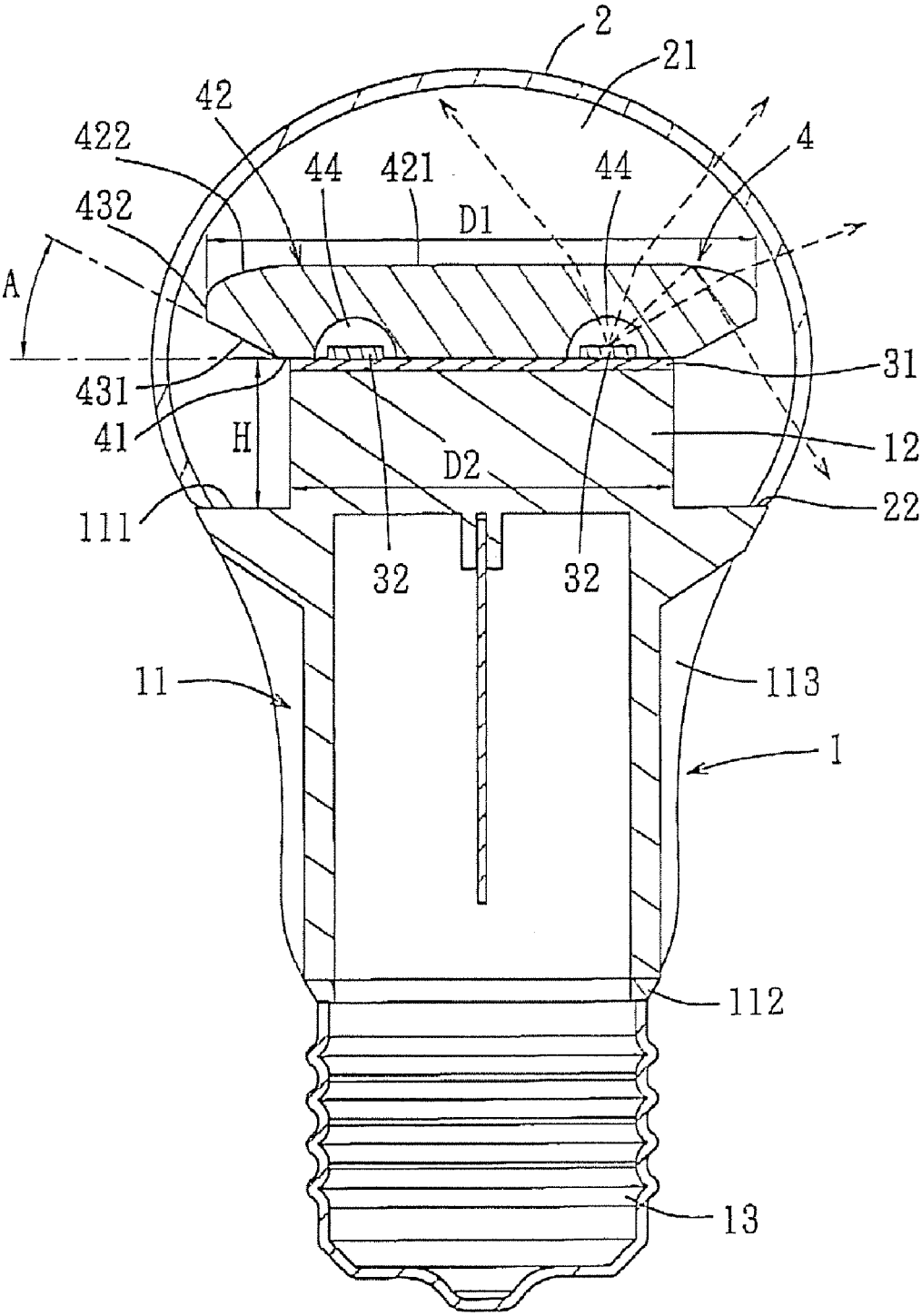
FIG. 2 is a sectional view of the first preferred embodiment.

Referring to FIGS. 1 and 2, the first preferred embodiment of a luminaire according to this invention includes a lamp holder 1, a lamp cover 2, a light-emitting module 3, and a light guide element 4.

The lamp holder 1 has a base part 11, a platform part 12 protruding from a top surface 111 of the base part 11 and having a predetermined height, and a coupling part 13 disposed on a bottom end 112 of the base part 11. The lamp cover 2 and the lamp holder 1 cooperate to define an accommodating space 21 therebetween. The lamp cover 2 has an annular connecting part 22 connected to the lamp holder 1. A driving circuit unit (not shown) is disposed within the lamp holder 1, and is electrically connected to the light-emitting module 3. The base part 11 is provided with a plurality of heat-dissipating fins 113 formed on an outer surface thereof for dissipating heat from the light-emitting module 3. The base part 11 and the platform part 12 are made of metal so as to achieve a good heat-dissipating effect. The coupling part 13 is used for electrical connection with an external electric circuit (not shown).

The light-emitting module 3 is disposed in the accommodating space 21, and includes a circuit board 31 disposed on the platform part 12, and a plurality of LEDs 32 disposed on the circuit board 31 for emitting light upwardly therefrom. The LEDs 32 are distributed over the circuit board 31 in a circumferential direction, and are spaced apart from the top surface 111 of the base part 11 by a predetermined distance (H) due to the presence of the platform part 12 and the circuit board 31. That is, the predetermined distance (H) is equal to the sum of the heights of the platform part 12 and the circuit board 31, and is the distance between a top surface of the platform part 12 and the top surface 111 of the base part 11. In this embodiment, since the connecting part 22 of the lamp cover 2 and the top surface 111 of the base part 11 are generally located at the same level, the LEDs 32 are higher than the connecting part 22 by the predetermined distance (H), so that inclined light beams transmitted downwardly and outwardly from the light guide element 4 cannot be obstructed by the lamp holder 1. The light guide element 4 will be described in greater detail hereinafter. Preferably, the light-emitting module 3 is disposed at a height position of the lamp cover 2 whereat the lamp cover 2 has a maximum diameter so as to achieve the optimum view angle. The predetermined distance (H) is between 10 and 12 mm. In this embodiment, the predetermined distance (H) is 11.6 mm.

The light guide element 4 is disposed on the platform part 12 of the lamp holder 1 and in the accommodating space 21 for covering the light-emitting module 3. The light guide element 4 has a bottom surface 41, a top surface 42 opposite to the bottom surface 41, a side surface 43 interconnecting the bottom surface 41 and the top surface 42, and a plurality of curved cavities 44 formed in the bottom surface 41 for receiving the LEDs 32, respectively. Preferably, the curved cavities 44 are of a semi-spherical shape so as to allow each light beam emitted from the LEDs 32 to enter the light guide element 4 in a normal line direction to thereby avoid light loss resulting from refraction. In this embodiment, when viewed from the top, the light guide element 4 has a circular outline and thus the side surface 43 is circular, and surrounds the light guide element 4. The top surface 42 has a flat area 421 and a curved area 422 surrounding the flat area 421. The flat area 421 of the top surface 42 is parallel to the bottom surface 41, and has the same horizontal length as the bottom surface 41. The side surface 43 has an inclined area 431 extending outwardly and upwardly from a periphery of the bottom surface 41, and an upright outer annular area 432 extending upwardly from an outer periphery of the inclined area 431. The curved area 422, the inclined area 431, and the outer annular area 432 are annular. The outer annular area 432 defines the outer diameter (D1) of the light guide element 4. The bottom surface 41 of the light guide element 4 covers the platform part 12 and the circuit board 31. Preferably, the outer diameter (D1) of the light guide element 4 is 1.1 to 1.5 times the outer diameter (D2) of the platform part 12, thereby allowing all of the light beams emitted from the LEDs 32 to enter the light guide element 4 to thereby be uniformly transmitted out. In this embodiment, the outer diameter (D1) of the light guide element 4 is 50 mm, and the outer diameter (D2) of the platform part 12 is 35 mm. The light refraction angle is increased due to the presence of the curved area 422. Total reflection is prevented due to the presence of the inclined area 431, so as to allow light beams to be transmitted out of the light guide element 4 through the inclined area 431. In addition, a cone angle of a longitudinal section (see FIG. 2) of the curved area 422 has a conic constant of 0.1 to 0.9. Alternatively, the cone angle is replaced with a round angle that has a curvature radius of 1 to 5 mm. In this embodiment, the conic constant of the cone angle is 0.4. Preferably, the inclined area 431 has an inclined side that forms an angle (A) of 20 to 60 degrees with respect to a plane of the bottom surface 41. In this embodiment, the angle (A) is 28.1 degrees. Preferably, the thickness of the light guide element 4 (i.e., the distance between the bottom surface 41 and the flat area 421 of the top surface 42) is between 5 and 20 mm. In this embodiment, the thickness is 8.5 mm.

Figure 3:
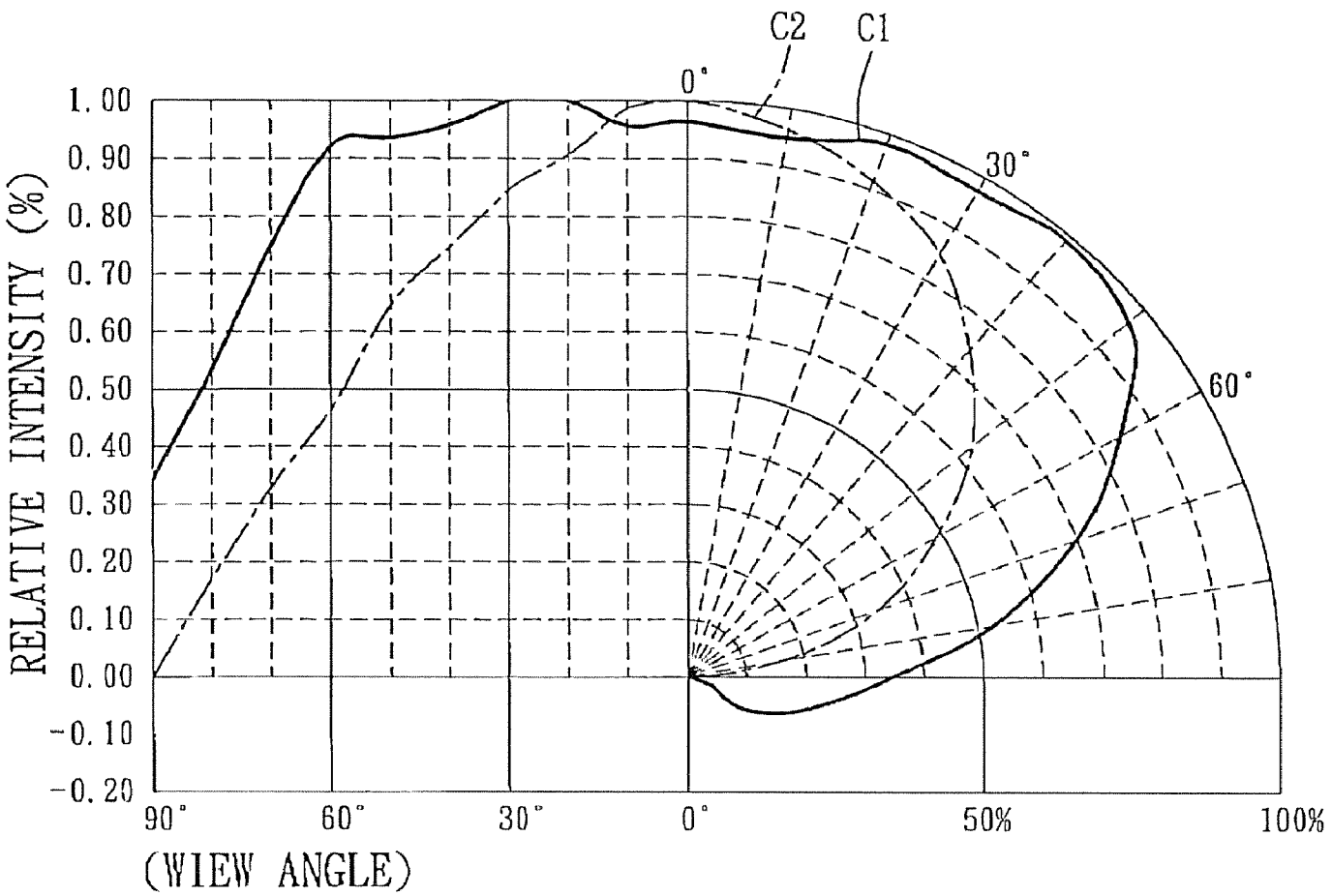
FIG. 3 is a comparison data diagram of a relative intensity to a view angle of a luminaire explaining the improvement of this invention.

As such, the light beams emitted from the light-emitting module 3 pass through the curved cavities 44 to enter the light guide element 4. A majority of the light beams emitted onto the flat area 421 of the top surface 42 are directly transmitted out of the light guide element 4. Although a minority of the light beams emitted onto the flat area 421 may be reflected totally, it can still be transmitted out of the light guide element 4 when reaching the inclined area 431. The refraction angle of each light beam emitted onto the curved area 422 of the top surface 42 is increased by virtue of curvature of the curved area 422. A majority of the light beams emitted onto the curved area 422 can be directly transmitted out of the light guide element 4, so that the view angle is increased by virtue of curvature of the curved area 422. The remaining light beams emitted onto the curved area 422 are transmitted onto the inclined area 431 and out of the light guide element 4 thereat since total reflection is prevented by the inclined area 431. Since the light-emitting module 3 is above the top surface 111 of the base part 11 and the connecting part 22, light beams transmitted from the inclined area 431 can pass through the lamp cover 2 to increase the view angle of the luminaire. With further reference to FIG. 3, the view angle of the luminaire of this invention is up to 160 degrees, as shown by a first curve (C1), and the view angle of a conventional luminaire is only about 120 degrees, as shown by a second curve (C2). That is, the view angle of the luminaire of this invention is wider than that of the conventional luminaire, and is approximate to that of an incandescent bulb.

Figure 4:
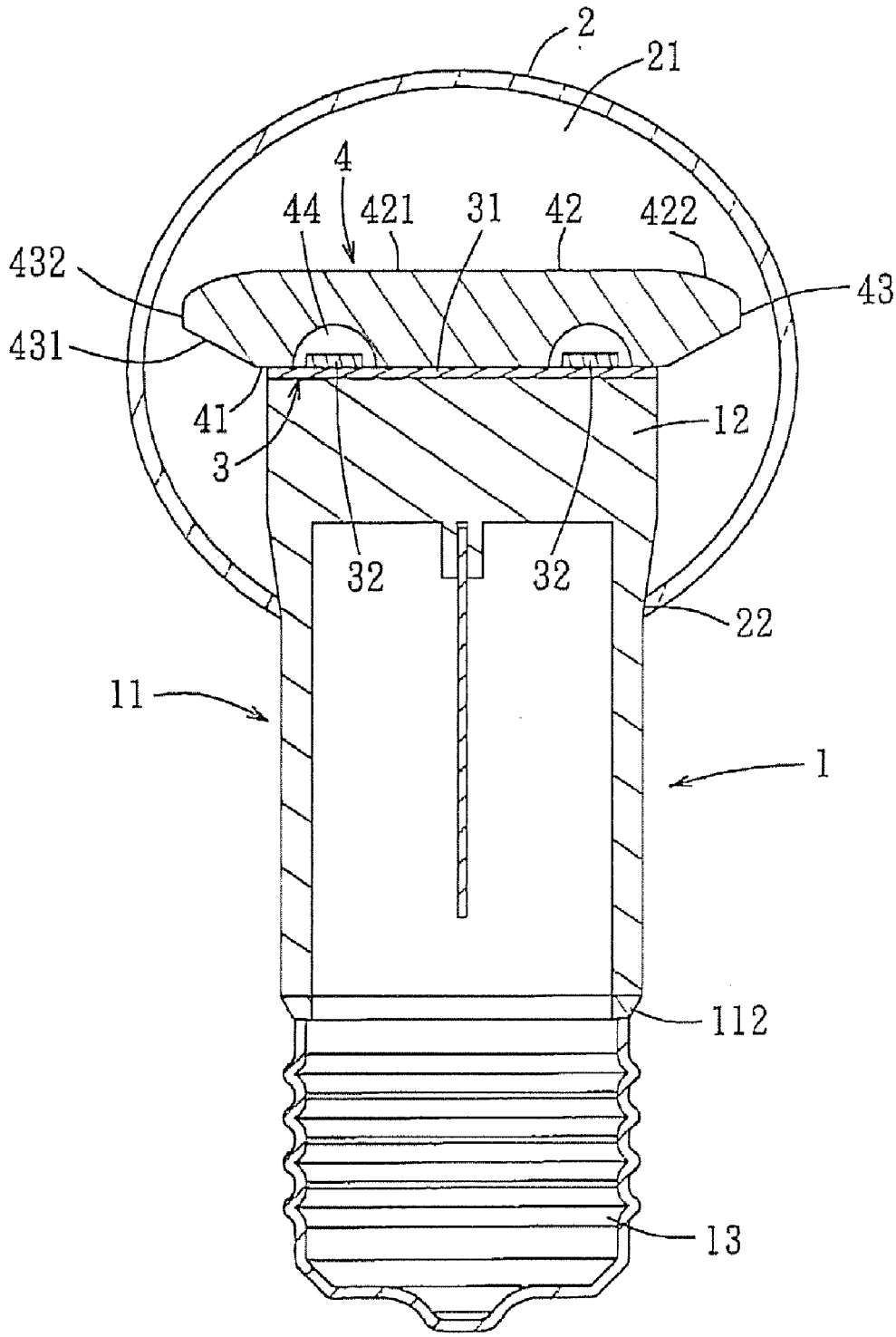
FIG. 4 is a sectional view of the second preferred embodiment of a luminaire according to this invention.

FIG. 4 shows the second preferred embodiment of a luminaire according to this invention, which is similar in construction to the first preferred embodiment. In this embodiment, an assembly of the platform, part 12 and the base part 11 of the lamp holder 1 is not two stepped, and the platform part 12 extends upwardly from the whole top surface of the base part 11 into the accommodating space 21 in the lamp cover 2. In this manner, the light-emitting module 3 is also located above the connecting part 22.

The first and second preferred embodiments are exemplified using lamp bulbs. The remaining preferred embodiments will be exemplified using lamp tubes.

Figure 5:
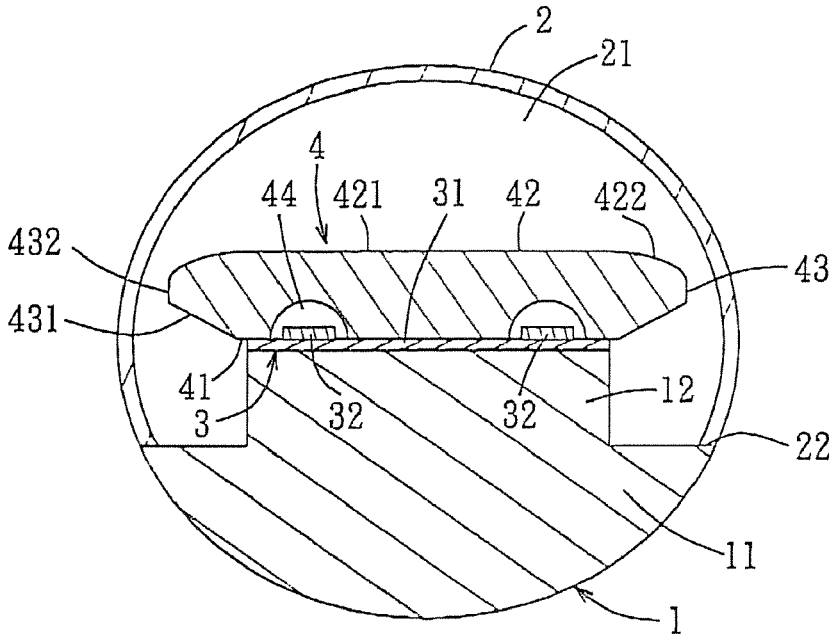
FIG. 5 is a sectional view of the third preferred embodiment of a luminaire according to this invention.

FIG. 5 is a cross sectional view of the third preferred embodiment of a luminaire according to this invention. Unlike the first preferred embodiment, in this embodiment, the lamp holder 1, the lamp cover 2, the circuit board 31, and the light guide element 4 are elongated, and extend in a direction perpendicular to the drawing sheet. The base part 11 of the lamp holder 1 has a curved bottom end cooperating with the lamp cover 2 to constitute a cylindrical outer appearance, and is circular in cross-section. The platform part 12, the circuit board 31, and the light guide element 4 are elongated. The LEDs 32 are arranged on the circuit board 31 in one row or two rows. In this embodiment, the LEDs 32 are arranged on the circuit board 31 in two rows. One row of the LEDs 32 is aligned respectively with the other row of the LEDs 32. Alternatively, one row of the LEDs 32 is arranged alternately with the other row of the LEDs 32. The base part 11 of the lamp holder 1 may be designed to have a specific heat-dissipating structure according to the needs. However, since the heat-dissipating structure is not pertinent to the claimed invention, a detailed description thereof will be omitted herein for the sake of brevity.

Figure 6:
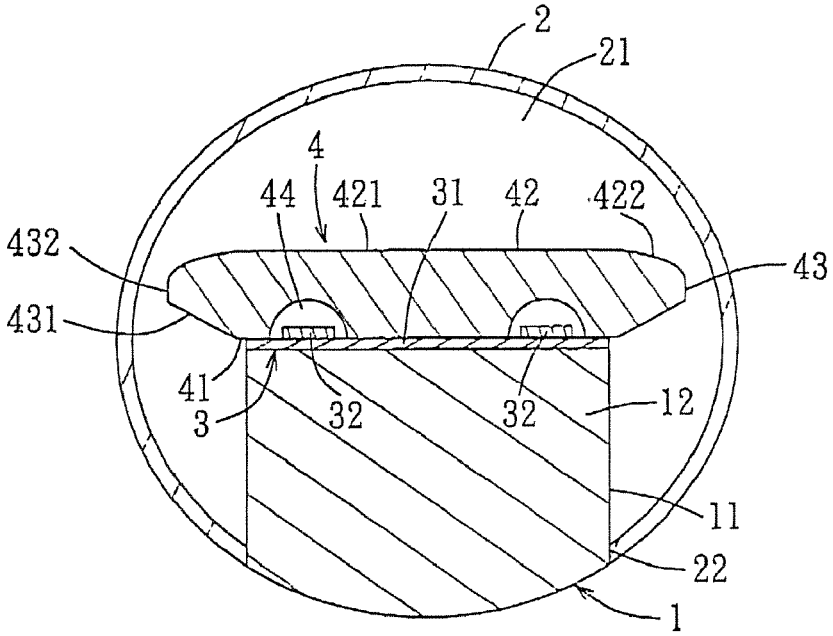
FIG. 6 is a sectional view of the fourth preferred embodiment of a luminaire according to this invention.

FIG. 6 shows the fourth preferred embodiment of a luminaire according to this invention, which is similar in construction to the third preferred embodiment. In this embodiment, an assembly of the platform part 12 and the base part 11 of the lamp holder 1 is not two stepped, and the platform part 12 extends upwardly from the whole top surface of the base part 11 into the accommodating space 21 in the lamp cover 2. In this manner, the light-emitting module 3 is also located above the connecting part 22.

Figure 7:
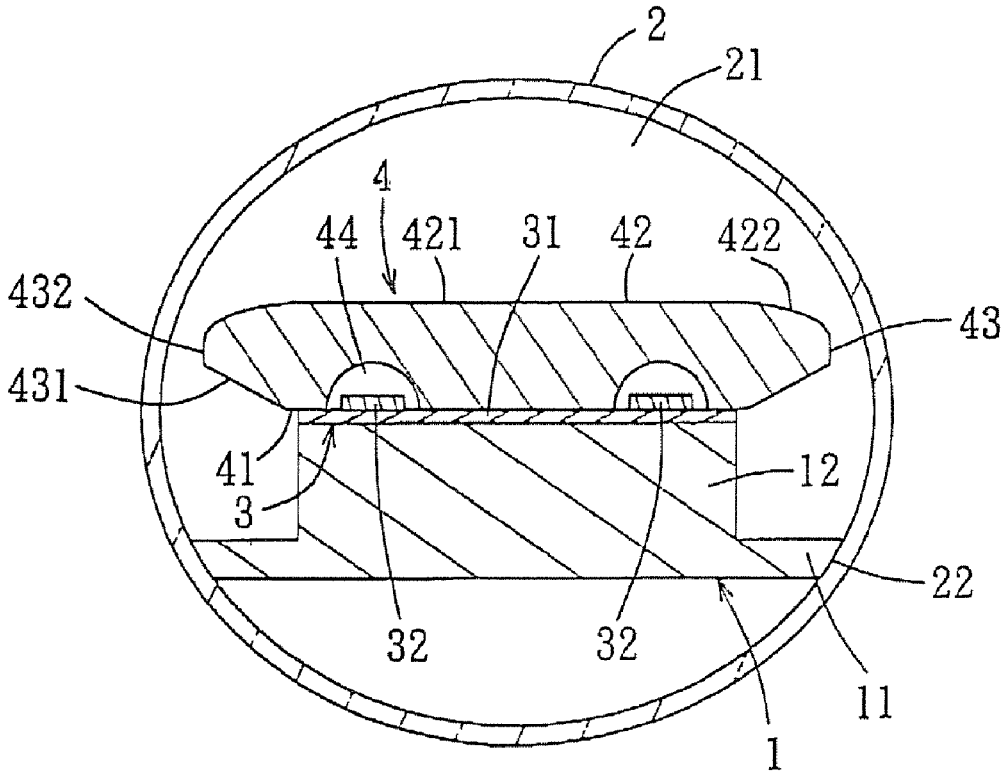
FIG. 7 is a sectional view of the fifth preferred embodiment of a luminaire according to this invention.

FIG. 7 shows the fifth preferred embodiment of a luminaire according to this invention, which is similar in construction to the third preferred embodiment. In this embodiment, the lamp cover 2 is tubular, and the lamp holder 1 is fixed in the lamp cover 2. The lamp cover 2 is connected to the lamp holder 1 at a connecting part 22. The light-emitting module 3 is also located above the connecting part 22.

The platform part 12 and the base part 11 of each of the above-mentioned preferred embodiments are formed integrally with each other. Alternatively, the platform part 12 and the base part 11 may be two separate members that are interconnected fixedly.

In view of the above, the luminaire of this invention can be a lamp bulb or a lamp tube. Since the curved area 421 and the inclined area 431 of the light guide element 4 as well as the light-emitting module 3 are disposed on the platform part 12 of the lamp holder 1, the light-emitting module 3 is above the connecting part 22 so as to increase the view angle of the luminaire. Thus, the object of this invention is achieved.

With this invention thus explained, it is apparent that numerous modifications and variations can be made without departing from the scope and spirit of this invention. It is therefore intended that this invention be limited only as indicated by the appended claims.

We claim:

1. A luminaire comprising:

a lamp cover:

a lamp holder connected to said lamp cover so as to define an accommodating space therebetween, said lamp holder having a platform part protruding into said accommodating space;

a light-emitting module disposed on said platform part of said lamp holder and including a circuit board and at least one LED disposed on said circuit board; and a light guide element disposed on said platform part for covering said light-emitting module, said light guide element having an outer diameter longer than that of said platform part.

2. The luminaire as claimed in claim 1, wherein said light guide element has a bottom surface, a top surface opposite to said bottom surface, and a side surface interconnecting said bottom surface and said top surface, said top surface having a flat area parallel to said bottom surface, and a curved area surrounding said flat area, said bottom surface covering said platform part and said circuit board.

3. The luminaire as claimed in claim 2, wherein said side surface has an inclined area extending outwardly and upwardly from a periphery of said bottom surface, and an outer annular area extending upwardly from an outer periphery of said inclined area.

4. The luminaire as claimed in claim 3, wherein said inclined area of said light guide element has an inclined side that forms an angle between 20 and 60 degrees with respect to a plane of said bottom surface.

5. The luminaire as claimed in claim 3, wherein said outer annular area defines the outer diameter of said light guide element.

6. The luminaire as claimed in claim 2, wherein a cone angle of a longitudinal section of the curved area of said light guide element has a conic constant of 0.1 to 0.9.

7. The luminaire as claimed in claim 2, wherein a round angle of a longitudinal section of said curved area of said light guide element has a curvature radius of 1 to 5 mm.

8. The luminaire as claimed in claim 2, wherein the outer diameter of said light guide element is 1.1 to 5 times that of said platform part.

9. The luminaire as claimed in claim 2, wherein said light guide element has at least one curved cavity formed in said bottom surface for receiving said LED.

10. The luminaire as claimed in claim 1, wherein said light-emitting module is disposed at a height position of said lamp cover whereat said lamp cover has a maximum diameter.

11. The luminaire as claimed in claim 1, wherein said lamp cover has a connecting part connected to said lamp holder, said light-emitting module being located above said connecting part.

12. The luminaire as claimed in claim 11, wherein said lamp holder has a base part, said platform part extending upwardly from a top surface of said base part and having a predetermined height, said lamp cover being connected to said base part.

13. A luminaire comprising:

a lamp holder;

a lamp cover connected to said lamp holder so as to define an accommodating space therebetween, said lamp cover having a connecting part connected to said lamp holder;

a light-emitting module disposed on said lamp holder and in said accommodating space, said light-emitting module being located above said connecting part; and a light guide element disposed on said lamp holder and in said accommodating space for covering said light-emitting module, said light guide element having a bottom surface adjacent to said light-emitting module, a top surface opposite to said bottom surface, and a side surface interconnecting said bottom surface and said top surface, said top surface having a curved area located at a periphery thereof.

14. The luminaire as claimed in claim 13, wherein said lamp holder has a base part and a platform part disposed on said base part, said platform part protruding into said accommodating space, said light-emitting module and said light guide element being disposed on said platform part, said light guide element having an outer diameter longer than that of said platform part.

15. The luminaire as claimed in claim 13, wherein said light-emitting module includes a circuit board and at least one LED disposed on said circuit board.

16. A luminaire comprising:

a lamp holder having a base part and a platform part disposed on said base part;

a lamp cover connected to said base part of said lamp holder;

a light-emitting module disposed on said platform part of said lamp holder and disposed at a height position of said lamp cover whereat said lamp cover has a maximum diameter; and a light guide element disposed on said platform part for covering said light-emitting module, said light guide element having an outer diameter longer than that of said platform part.

17. The luminaire as claimed in claim 16, wherein said light guide element has a bottom surface, a top surface opposite to said bottom surface, and a side surface interconnecting said bottom surface and said top surface, said top surface having a flat area parallel to said bottom surface, and a curved area surrounding said flat area, said bottom surface covering said platform part and a circuit board of said light-emitting module.

18. The luminaire as claimed in claim 16, wherein said side surface has an inclined area extending outwardly and upwardly from a periphery of said bottom surface, and an outer annular area extending upwardly from an outer periphery of said inclined area.

* * * * *